US007862145B2

(12) United States Patent
Umezawa

(10) Patent No.: US 7,862,145 B2
(45) Date of Patent: Jan. 4, 2011

(54) PRINTING APPARATUS AND METHOD OF CONTROLLING THE SAME

(75) Inventor: Masahiko Umezawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/145,139

(22) Filed: Jun. 24, 2008

(65) Prior Publication Data

US 2009/0002420 A1 Jan. 1, 2009

(30) Foreign Application Priority Data

Jun. 29, 2007 (JP) ..... 2007-173114

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS

2004/0207683 A1* 10/2004 Sonobe ..... 347/23
2006/0061617 A1* 3/2006 Udagawa ..... 347/23

FOREIGN PATENT DOCUMENTS

JP 2004-50518 * 2/2004 ..... 347/23
JP 2004-58528 2/2004

* cited by examiner

*Primary Examiner*—Julian D Huffman
(74) *Attorney, Agent, or Firm*—Fitzpatrick, Cella, Harper & Scinto

(57) ABSTRACT

An object of this invention is to properly prevent clogging of each nozzle in order to stably discharge ink without increasing a circuit scale even when the number of nozzles increases. For this purpose, the number of ink discharges from each printing element is stored in a memory. The number of ink discharges from each printing element that is measured from input printing data is subtracted from that stored in the memory, and the subtraction result is rewritten into the memory. The subtraction result is checked in a predetermined period, and if the number of ink discharges from each printing element is equal to or larger than a predetermined count, preliminary discharge to be performed periodically is suppressed.

8 Claims, 14 Drawing Sheets

PRINTING APPARATUS AND METHOD OF CONTROLLING THE SAME

BACKGROUND OF THE INVENTION

1. Field of the Invention

The present invention relates to a printing apparatus and control method therefor, and particularly to a printing apparatus which prints using an inkjet printhead, and a control method therefor.

2. Description of the Related Art

An inkjet printing apparatus generally comprises a carriage which supports a printhead and ink tank, a conveyance means for conveying a printing medium such as printing paper, and a control means for controlling the carriage and conveyance means. The inkjet printing apparatus prints by discharging ink onto a printing medium while the printhead having a plurality of printing elements (to be also referred to as nozzles hereinafter) for discharging ink droplets moves in a direction (main scanning direction) perpendicular to the printing medium conveyance direction (sub-scanning direction). At this time, the printhead in which many nozzles for discharging ink are arranged in line in the sub-scanning direction scans the printing medium once, thereby printing by a width corresponding to the number of nozzles.

In a conventional inkjet printing apparatus, in order to prevent ink from sticking to the internal wall of the nozzle of a printhead, the ink discharge surface of the printhead is generally capped to prevent evaporation of the ink solvent when performing no printing operation. Even during the printing operation, however, some of nozzles are hardly used or hardly discharge ink. These nozzles are exposed to the atmosphere for a long time without discharging ink while they are not capped with the ink-sticking prevention cap. As a result, the ink solvent evaporates from these nozzles, and ink sticks to their internal walls.

The stuck ink clogs the nozzle, causing an ink discharge failure. Conventionally, clogging prevention control (to be referred to as preliminary discharge hereinafter) is executed to drive a printing element once at a predetermined time interval, for example several seconds, discharge old ink from the nozzle, and supply new ink to it even during the printing operation. However, when ink is discharged from all the nozzles of the printhead at a predetermined time interval, the running cost rises and the throughput decreases.

To prevent this, there is disclosed an inkjet printing apparatus having a plurality of counting means for counting the numbers of ink discharges from all nozzles, and a determination means for determining whether all nozzles have performed a predetermined number of ink discharges at a predetermined time interval T (Japanese Patent Laid-Open No. 2004-58528). If no predetermined number of ink discharges have been performed at the predetermined time interval T, T is subtracted from a time T' during which the printing operation can continue without performing preliminary discharge. If no predetermined number of ink discharges have still been performed, the difference between T' and the time during which no predetermined number of ink discharges have been performed becomes "0". Only when this difference becomes "0", preliminary discharge is performed. Since preliminary discharge is performed only when necessary, an increase in running cost and a decrease in throughput can be suppressed.

Recently, inkjet printing apparatuses have been required to print at higher speeds with higher image qualities. To meet this requirement, inkjet printing apparatuses perform high-speed, high-quality printing by increasing the number of nozzles of the printhead.

To implement high-quality, high-resolution printing, various proposals have been made for even the nozzle arrangement of the printhead.

FIG. 6 is a view showing a specific example of the nozzle arrangement of a printhead.

In the example shown in FIG. 6, for each of black (Bk), cyan (C), magenta (M), and yellow (Y) inks, the printhead has two nozzle arrays for discharging ink of each color. The nozzle arrays for discharging ink of each color are arranged symmetrically with respect to the array direction of the nozzle arrays. The printhead using the nozzle arrays of this arrangement reciprocates to print by discharging ink in the forward and backward scanning directions not to create the difference between colors printed by forward scanning and backward scanning.

FIG. 7 is a view showing another specific example of the nozzle arrangement of a printhead.

Similar to the printhead in FIG. 6, the printhead shown in FIG. 7 has two nozzle arrays for discharging ink of each color (FIG. 7 shows only an example of discharging cyan ink). In the printhead shown in FIG. 7, two nozzle arrays of nozzles arranged at 600 dpi are arranged at an interval of 1,200 dpi with a shift of a half pitch in the nozzle array direction (longitudinal direction in FIG. 7). The printhead having the nozzle arrays of this arrangement can print at high resolution, particularly in the nozzle array direction.

However, according to these conventional techniques, as the number of nozzles increases, the number of counters for counting the number of ink discharges also increases. The larger number of nozzles leads to a larger circuit scale. FIG. 3 is a circuit diagram showing an example of a circuit having counters in a printing apparatus described in Japanese Patent Laid-Open No. 2004-58528. The circuit shown in FIG. 3 is arranged for each nozzle array of the printhead. As is apparent from this circuit arrangement, as the number of nozzles increases, the number of counters (Counters) increases.

SUMMARY OF THE INVENTION

Accordingly, the present invention is conceived as a response to the above-described disadvantages of the conventional art.

For example, a printing apparatus and preliminary discharge control method according to this invention are capable of counting the number of ink discharges and properly preventing clogging of each printing element without increasing the circuit scale in an inkjet printhead having many printing elements.

According to one aspect of the present invention, preferably, there is provided a printing apparatus which divides printing elements into blocks, and time-divisionally drives the printing elements of the respective blocks to discharge ink to a printing medium, the apparatus comprising: input means for externally inputting printing data; generation means for generating a timing signal of time-divisional driving; evaluation means for evaluating, based on the printing data input from the input means, a driving count at which the printing elements are driven; memory means for holding information on the driving count for each block; update means for updating the information on the driving count stored in the memory means, based on the driving count evaluated by the evaluation means in synchronism with the timing signal; determination means for determining, based on the information on the driving count updated by the update means, whether or not to adjust a printable time; adjustment means for adjusting the printable time in a predetermined period, based on determination by the determination means; and control means for performing preliminary discharge from the printing elements, based on the printable time adjusted by the adjustment means.

According to another aspect of the present invention, preferably, there is provided a method of controlling a printing apparatus which divides printing elements into blocks, and time-divisionally drives the printing elements of the respective blocks to discharge ink to a printing medium, the method comprising: an input step of externally inputting printing data; a generation step of generating a timing signal of time-divisional driving; an evaluation step of evaluating, based on the printing data input in the input step, a driving count at which the printing elements are driven; an update step of updating the information on the driving count held in memory means, based on the driving count evaluated in the evaluation step in synchronism with the timing signal; a determination step of determining, based on the information on the driving count updated in the update step, whether or not to adjust a printable time; an adjustment step of adjusting the printable time in a predetermined period, based on a result of determination in the determination step; and a control step of performing preliminary discharge from the printing elements, based on the printable time adjusted in the adjustment step.

The invention is particularly advantageous since the number of ink discharges can be counted to properly prevent clogging of each printing element without increasing the circuit scale in an inkjet printhead having many printing elements.

Further features of the present invention will become apparent from the following description of exemplary embodiments (with reference to the attached drawings).

DESCRIPTION OF THE EMBODIMENT

A preferred embodiment of the present invention will now be described in detail in accordance with the accompanying drawings.

The following embodiment will exemplify a printing apparatus having an inkjet printhead.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Figure 1:
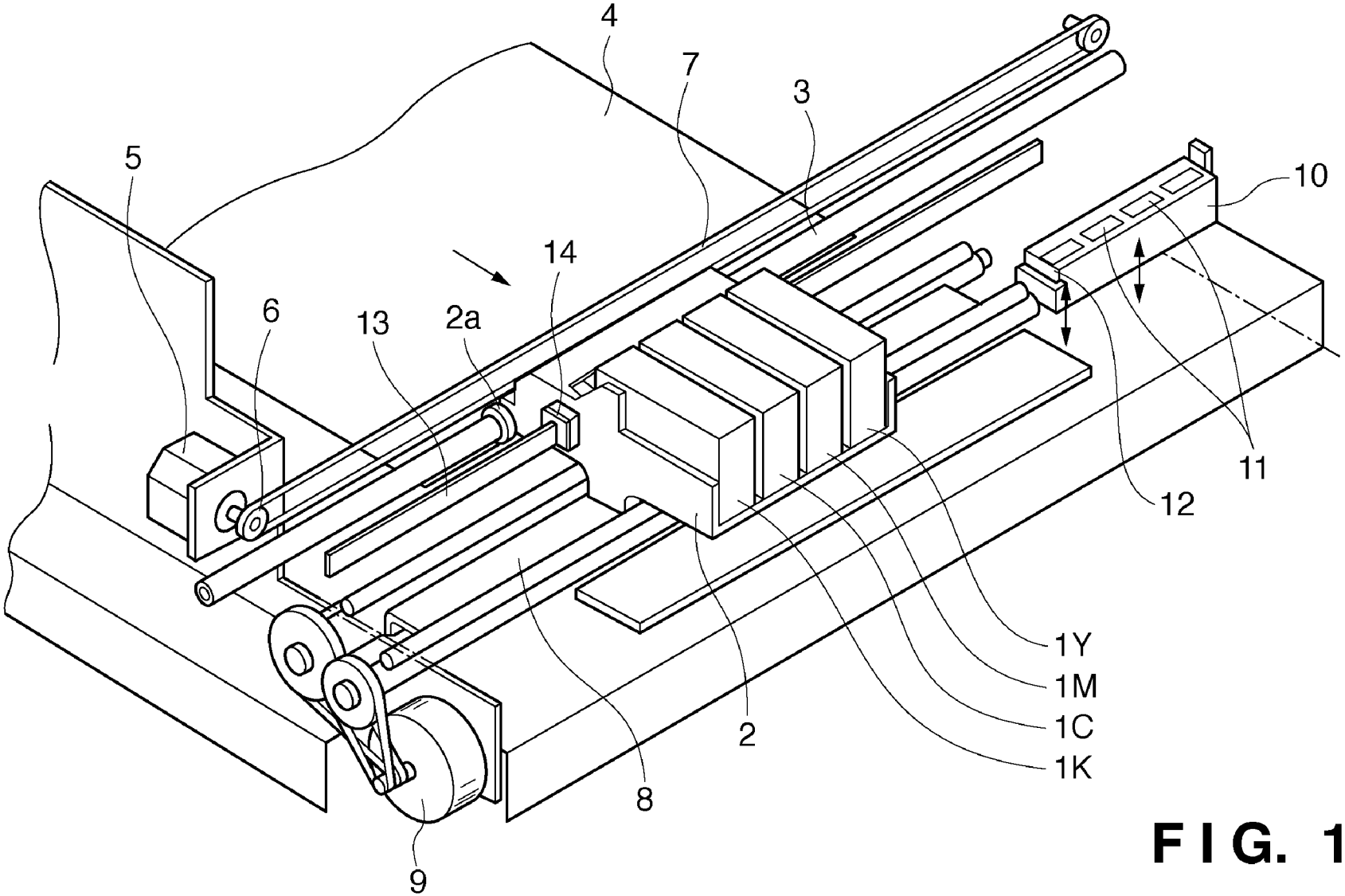
FIG. 1 is a perspective view showing the schematic structure of an inkjet printing apparatus as a typical embodiment of the present invention.

FIG. 1 is a perspective view showing the schematic structure of an inkjet printing apparatus (to be also simply referred to as a printing apparatus hereinafter) as a typical embodiment of the present invention.

A printhead 1 used in the embodiment is a printhead according to, among inkjet printing methods, a method of heating ink using an electrothermal transducer (e.g., a heating resistance element) as an energy generation means, and discharging ink droplets by heat energy. The printhead 1 prints a high-resolution, high-precision image.

The printhead 1 is connected to four ink tanks: an ink tank 1C containing cyan (C) ink, an ink tank 1M containing magenta (M) ink, an ink tank 1Y containing yellow (Y) ink, and an ink tank 1K containing black (Bk) ink. A carriage 2 supports the printhead 1 and the ink tanks 1C, 1M, 1Y, and 1K. As is apparent from FIG. 1, the four ink tanks are mounted on the carriage 2 while arranged along the direction of length of a guide shaft 3, that is, arranged along the moving direction of the carriage 2.

As shown in FIG. 1, the printhead 1 is mounted on the carriage 2 in a posture for discharging ink downward. While a bearing 2*a* of the carriage 2 moves relatively to a printing medium 4 such as printing paper along the guide shaft 3, the printhead 1 discharges ink droplets to form an image by one scanning on the printing medium 4. The carriage 2 reciprocates along the guide shaft 3 via a timing belt 7 upon rotation of a pulley 6 which receives the driving force of a carriage motor 5.

After the end of printing by one scanning of the printhead 1, the printhead 1 halts printing. At this time, a conveyance motor 9 is driven to convey the printing medium 4 positioned on a platen 8 by a predetermined amount in a direction perpendicular to the moving direction of the carriage 2. After that, an image is formed by the next scanning while the carriage 2 moves along the guide shaft 3. These operations are repeated to form an image on the entire printing medium 4.

In FIG. 1, a recovery unit 10 is arranged on the right side of the printing apparatus to perform a recovery operation for maintaining a good ink discharge state of the printhead 1. A preliminary discharge port (not shown) is formed on the side of the recovery unit 10 to perform preliminary discharge for preventing clogging. The recovery unit 10 has a cap 11 which caps the ink discharge surface of the printhead 1, a wiper 12 which wipes the ink discharge surface of the printhead 1, and a suction pump (not shown) which sucks ink from the printing element (nozzle) of the printhead 1.

The printing apparatus according to the embodiment comprises an encoder scale 13 and encoder 14 to detect the moving speed of the carriage 2 so that the printing apparatus perform can perform feedback control for the carriage motor 5 when driving it. The encoder 14 reads position information (slit) of the encoder scale 13 to obtain the ink discharge timing (to be referred to as a heating timing hereinafter) of the printhead 1.

Figure 6:
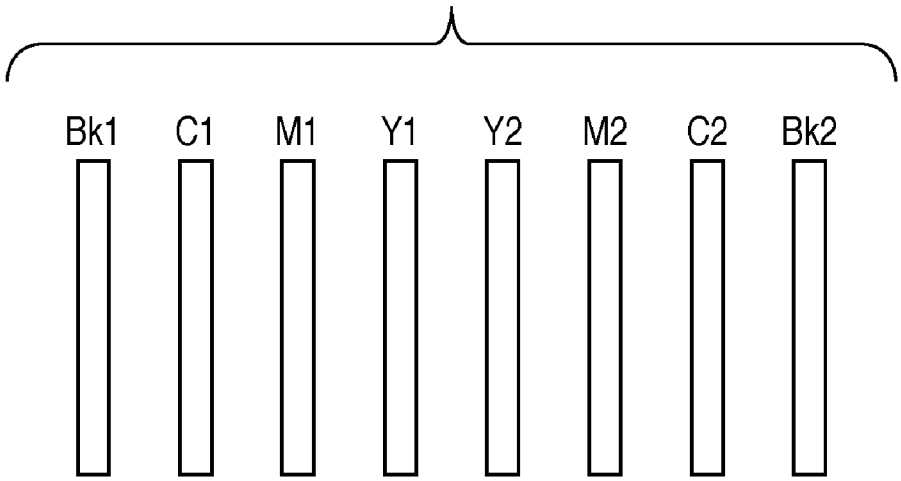
FIG. 6 is a view showing a specific example of the nozzle arrangement of a printhead.
Figure 7:
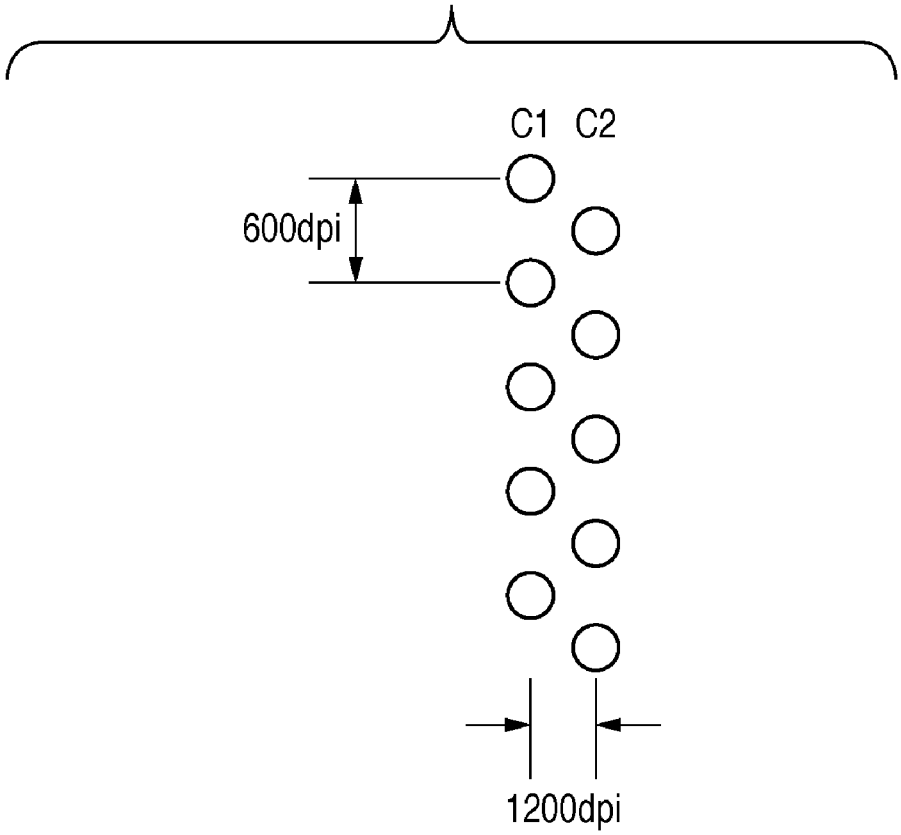
FIG. 7 is a view showing another specific example of the nozzle arrangement of a printhead.

The printhead 1 used in the embodiment is a color printhead which prints upon receiving four color inks from the four ink tanks described above. The printhead 1 has a nozzle arrangement as shown in FIG. 6. The printhead 1 reciprocally prints by discharging ink from two nozzle arrays corresponding to each ink in synchronism with reciprocation of the carriage 2. The printing apparatus can use not only a printhead having the nozzle arrangement shown in FIG. 7 but also a printhead having another nozzle arrangement.

Figure 2:
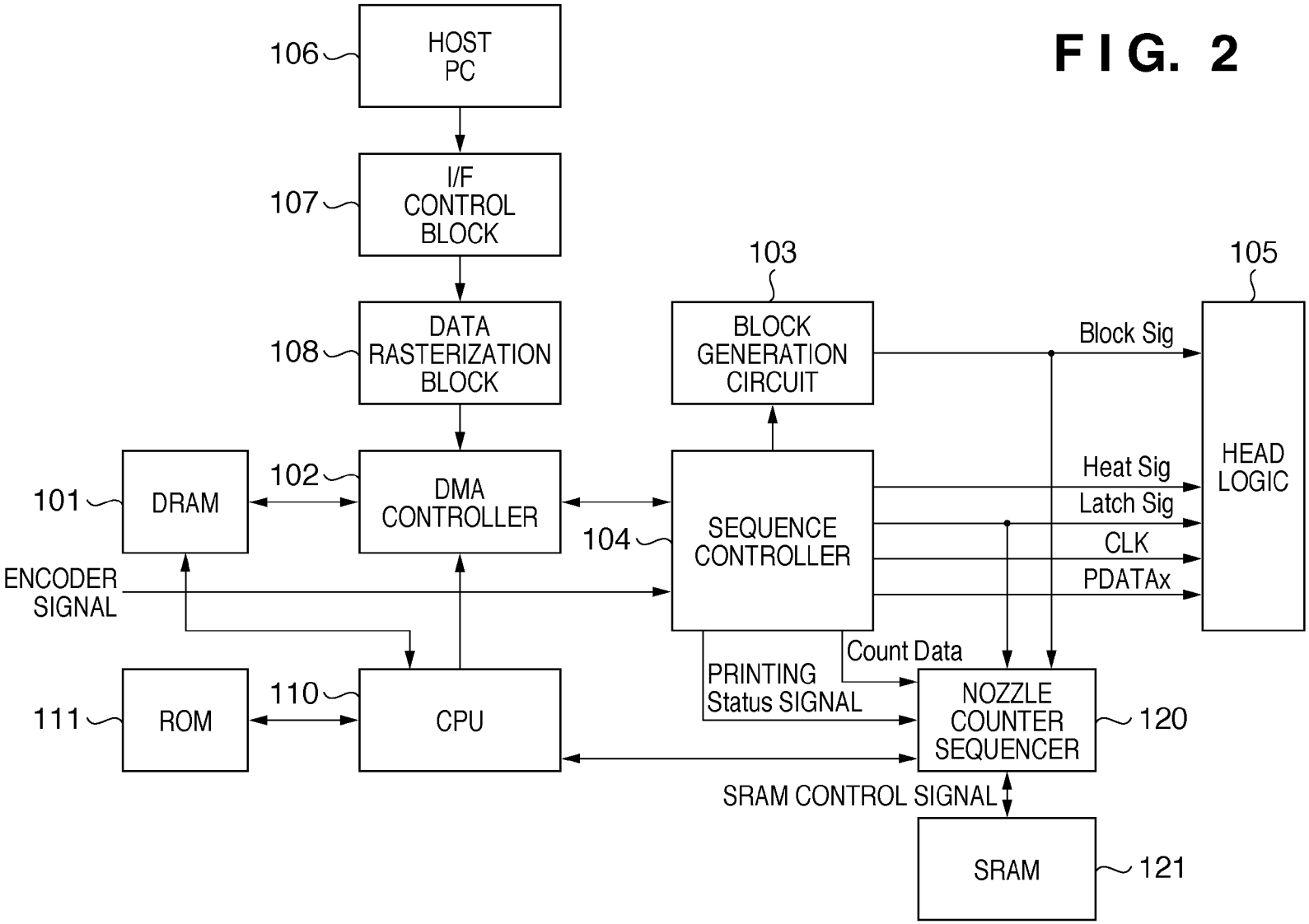
FIG. 2 is a block diagram of the internal arrangement of nozzle counter logic.
Figure 3:
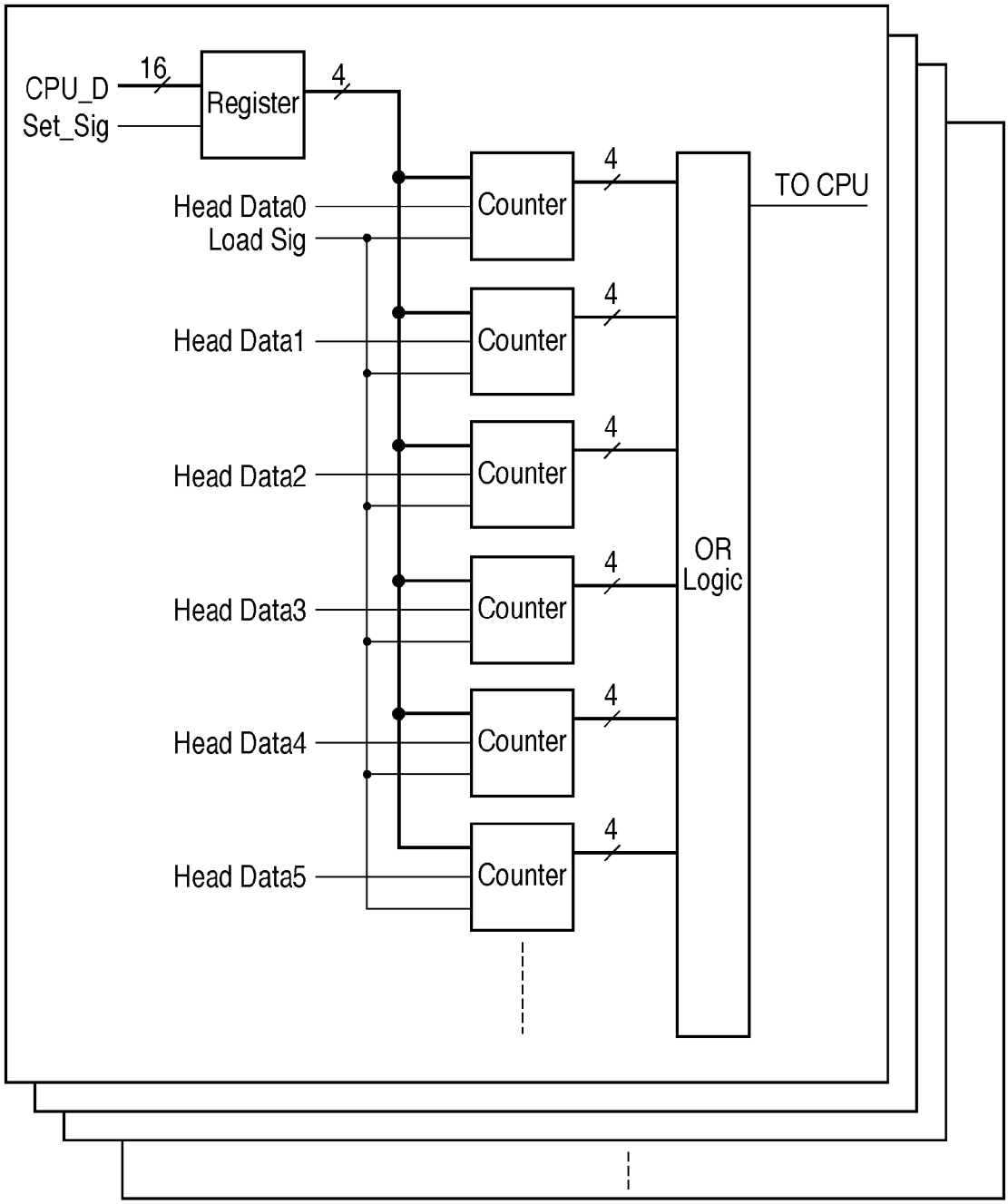
FIG. 3 is a circuit diagram showing an example of a conventional circuit having counters.

FIG. 2 is a block diagram of the internal arrangement of nozzle counter logic.

In the arrangement shown in FIG. 2, an interface (I/F) control block 107 in the printing apparatus receives printing data (color printing data) sent from a host PC 106. The printing data is also input externally from a digital camera and the like in addition to the host apparatus. A data rasterization block 108 rasterizes the received data into raster data of respective color components (Y, M, C, and Bk) of color printing data. An operation program is stored in a ROM 111, and properly read out by a CPU 110 to control the printer operation.

The printing data rasterized by the data rasterization block 108 is transferred to a DRAM 101 via a DMA controller 102 controlled by the CPU 110, and temporarily stored in the DRAM 101. A sequence controller 104 converts the raster data into column data, which are stored in an SRAM incorporated in the sequence controller 104. Each column data is data in unit of each nozzle array. Further, the sequence controller 104 rearranges the column data in the order of transfer to the printhead, and stores the rearranged data in the internal SRAM. More specifically, the sequence controller 104 rearranges the column data into printing data of respective blocks (e.g. data corresponding to block 0, data corresponding to block 1, and the like).

The printing data is transferred from the sequence controller 104 to head logic(logic circuit) 105 of the printhead 1. Upon transfer, the number of dots of transferred data is counted in advance to hold the count value. The timing of transfer and that of readout from the SRAM are based on a latch signal Latch Sig. The latch signal is generated based on an encoder signal output in accordance with movement of the printhead 1. The printing data read out from the SRAM is serially output from the sequence controller 104 to the head logic 105 via a signal line PDATAx in accordance with a clock signal CLK. After transferring the printing data, the latch signal Latch Sig is output to the head logic 105 to latch the printing data by a latch circuit in the head logic 105.

An SRAM 121 has 16 addresses for holding information on the driving count, and holds information on the driving count of each nozzle. For example, the SRAM 121 can hold 16-bit data at each address. The memory area at address 0 in the SRAM 121 is allocated to hold data of eight nozzles. The area of the SRAM 121 is defined such that data of eight nozzles belonging to block 0 are assigned to address 0, data of eight nozzles belonging to block 1 are assigned to address 1, and data of eight nozzles belonging to block 2 are assigned to address 2. The nozzle counter sequencer 120 performs write operation of data in the SRAM 121, read operation of data from the SRAM 121, initialization operation of the SRAM 121, and the like by using an SRAM control signal.

Address 0 will be exemplified. Data corresponding to nozzle number 0 are stored at bits 0 and 1, data corresponding to nozzle number 8 are stored at bits 2 and 3, and data corresponding to nozzle number 112 are stored at bits 14 and 15. The area is allocated in the same way for the remaining addresses.

The sequence controller 104 outputs a block selection signal Block Sig generated by a block generation circuit 103 to the head logic 105. In response to this, many printing elements are divided into a plurality of blocks, and the respective blocks are time-divisionally driven in accordance with a time-divisional driving timing signal. In this manner, time-divisional driving is performed to time-divisionally drive the respective blocks.

Figure 5:
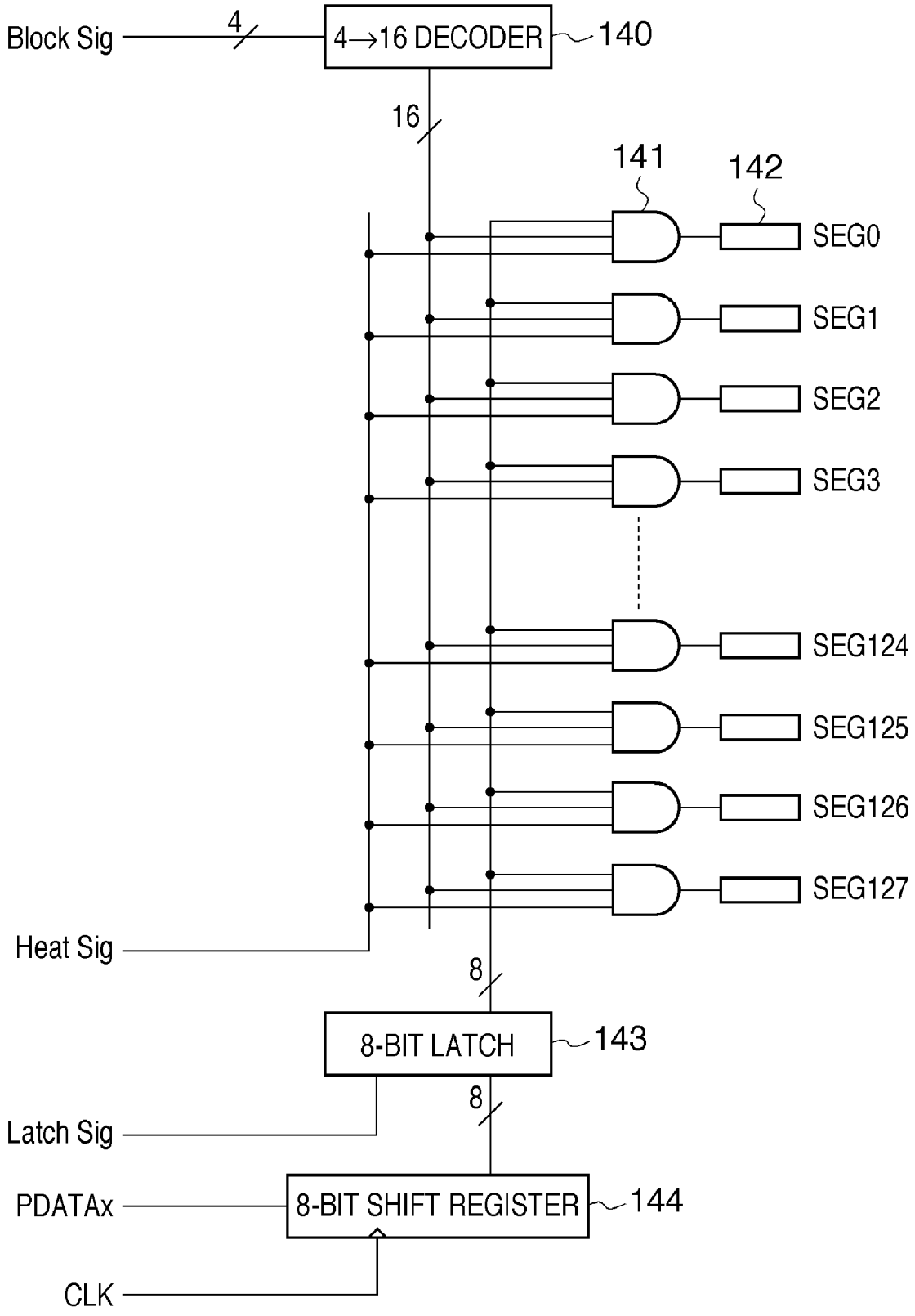
FIG. 5 is a circuit diagram of head logic.

FIG. 5 is a circuit diagram of the head logic 105 for one nozzle array.

Printing data PDATAx transmitted from the sequence controller 104 to the head logic 105 is input to an 8-bit shift register 144 in synchronism with CLK, and held by an 8-bit latch 143 in synchronism with Latch Sig. The printing data PDATAx is data in unit of block. For example, printing data corresponding to block 0 is PDATA0, printing data corresponding to block 1 is PDATA1, and printing data corresponding to block 15 is PDATA15. A 4→16 decoder 140 converts 4-bit Block Sig into block selection signals for selecting block 0 to block 15. Each AND circuit 141 receives PDATAx from the 8-bit latch 143, a block selection signal output from the 4→16 decoder 140, and a heat signal Heat Sig. A nozzle selected by the block selection signal is driven by Heat Sig based on the PDATAx value, heating a discharge heater 142. As a result, an ink droplet is discharged from desired segment SEG (nozzle) among segments SEG0 to SEG127.

Figure 8:
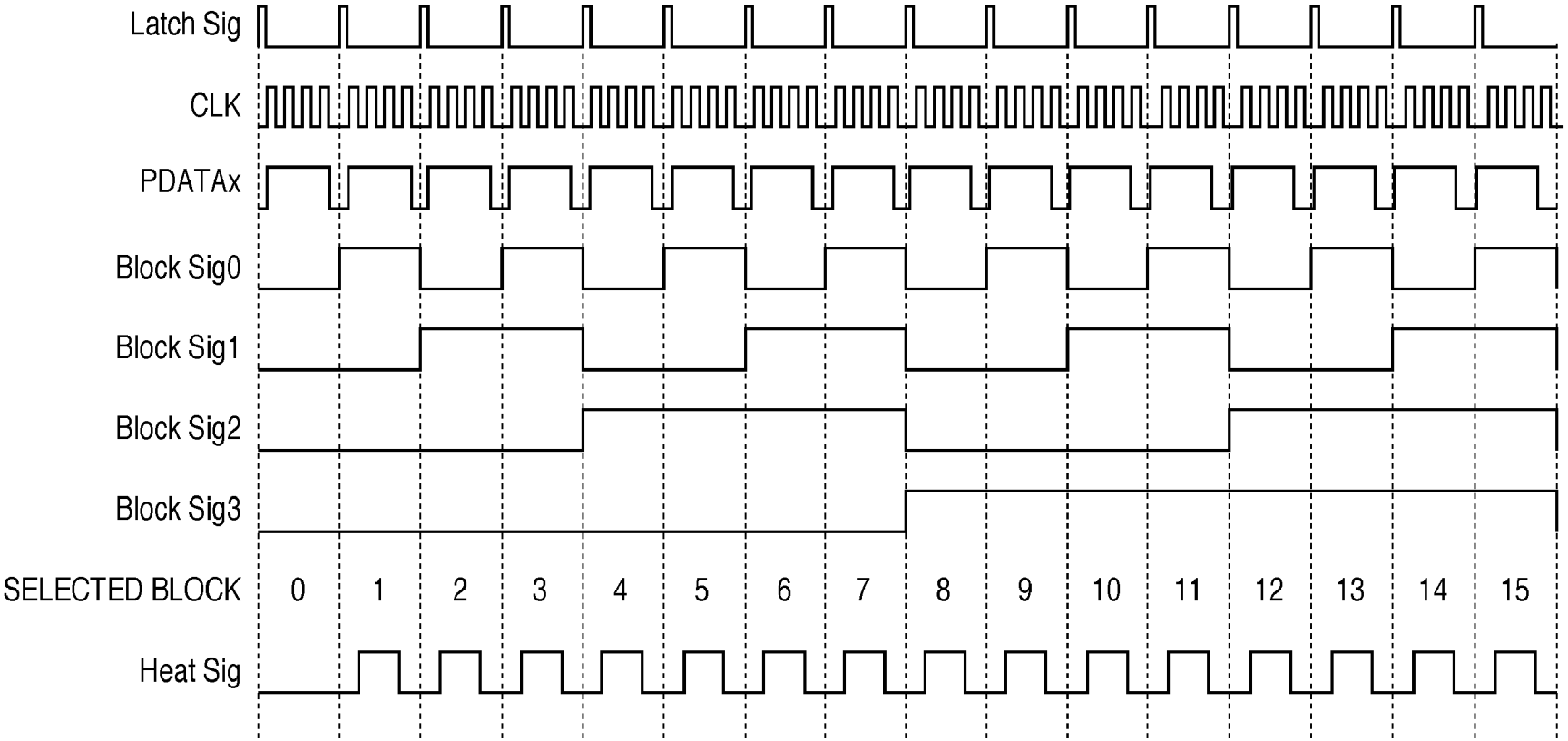
FIG. 8 is a timing chart of driving the head logic.

FIG. 8 is a timing chart of driving the head logic 105.

In FIG. 8, block 0 to block 15 are selected by Block Sig0 to Block Sig3. PDATAx is transmitted to the 8-bit latch 143 in synchronism with CLK, and latched in response to Latch Sig. A nozzle in a block selected by inputting PDATAx discharges ink in synchronism with Heat Sig. PDATAx is input to the 8-bit shift register 144 at the edges (leading and trailing edges) of CLK. That is, printing data transferred at a time is made up of eight bits, and transfer of printing data is repeated 16 times for block 0 to block 15, printing the printing data of one column by 128 nozzles.

Figure 12:
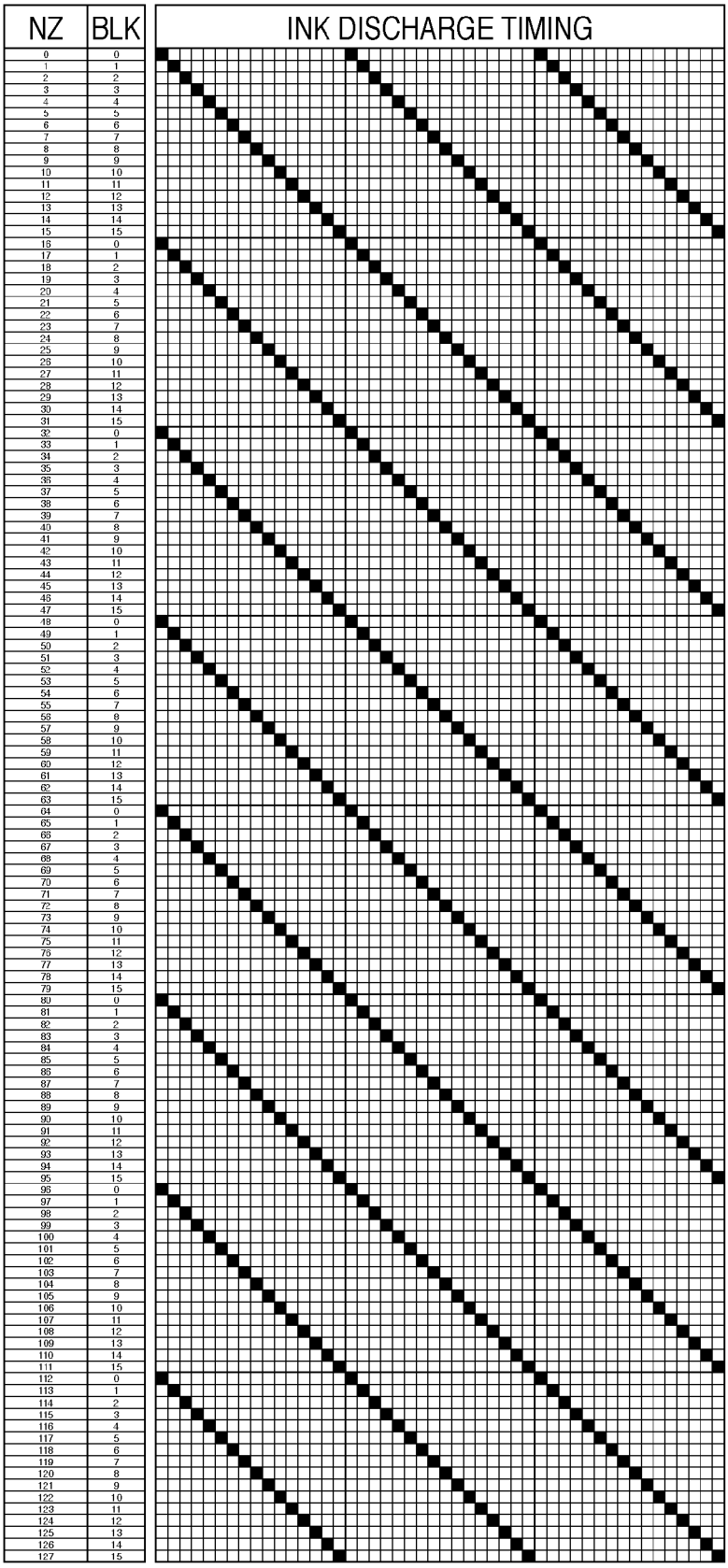
FIG. 12 is a view showing the ink discharge timing of each nozzle of a printhead which time-divisionally drives 16 blocks.

FIG. 12 is a view showing the ink discharge timing of each nozzle of the printhead which time-divisionally drives 16 blocks. FIG. 12 shows 48 driving timings. One driving (driving of one block) is performed in synchronism with output of one latch signal Latch Sig and heat signal Heat Sig.

Note that FIG. 12 shows an ink discharge timing with the lapse of time from left to right in FIG. 12.

For example, ink is discharged from all nozzles as follows. Eight dots of block 0 are printed at the first timing, and eight dots of block 1 are printed at the next timing. Dots of up to block 15 are printed in the order of block 2, 3, 4, . . . , completing printing based on data of 128 nozzles. By repeating this operation, an image is formed on a printing medium. For example, nozzles having nozzle numbers (NZs) 0 and 16 belong to block (BLK) 0, and are driven at the first timing (left end) shown in FIG. 12. Nozzles having nozzle numbers 1 and 17 belong to block 1, and are driven at the second timing (second from the left) shown in FIG. 12.

A nozzle counter sequencer 120 shown in FIG. 2 evaluates the amount of printing data transferred to the printhead, and stores the evaluation result in the memory (the SRAM 121). The printing data amount is, for example, the amount of data for driving nozzles, that is, the number of dots to be printed on a printing medium by nozzles.

Figure 4:
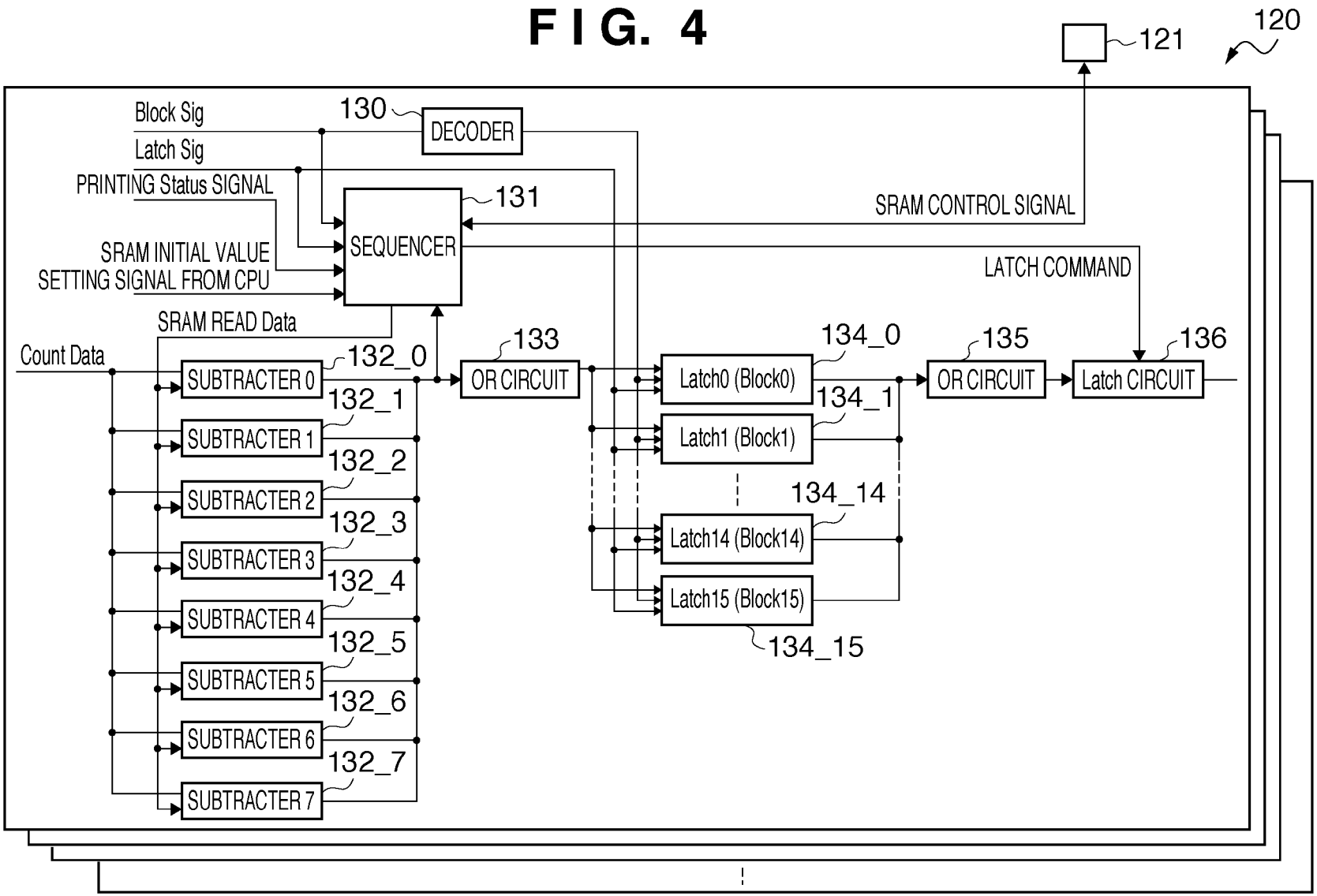
FIG. 4 is a block diagram of the internal arrangement of a nozzle counter sequencer.
Figure 15:
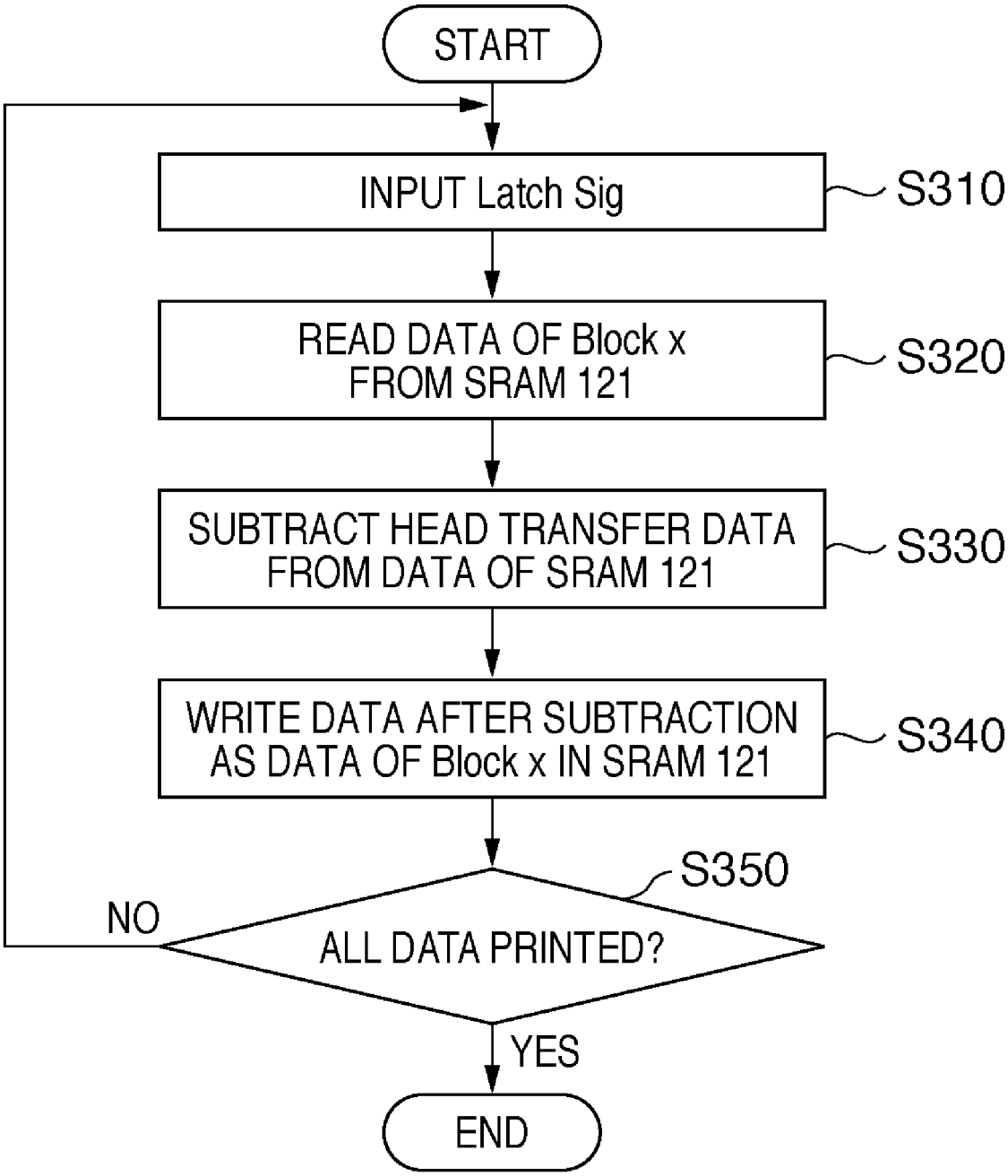
FIG. 15 is a flowchart showing the operation of the nozzle counter sequencer.

FIG. 4 is a block diagram of the internal arrangement of the nozzle counter sequencer 120. The nozzle counter sequencer 120 is arranged for each nozzle array of the printhead 1. An operation sequence from the start to end of printing in the nozzle counter sequencer 120 will be explained with reference to the flowchart shown in FIG. 15.

After printing starts, Latch Sig is input (step S310). In synchronism with the timing of Latch Sig, a sequencer 131 reads out data about the driving count of each nozzle in block x (Block x) selected by Block Sig stored in the SRAM 121 (step S320). For example, nozzle numbers corresponding to block 0 are 0, 16, 32, 48, . . . , 112. The sequencer 131 reads out data corresponding to these numbers from the SRAM 121. Each data is represented by two bits for one nozzle. One block includes eight nozzles.

Hence, the nozzle counter sequencer 120 has eight subtracters to individually subtract data of the nozzles of one block. The data read out from the SRAM 121 are allotted by two bits to subtracters 0 to 7 132_0 to 132_7. For example, data corresponding to nozzle number 0 is set in 132_0 (subtracter 0), data corresponding to nozzle number 16 is set in 132_1 (subtractor 1), and data corresponding to nozzle number 112 is set in 132_7 (subtractor 7). Count data (Count Data: data about the driving count of each nozzle of Block x) received from the sequence controller 104 is subtracted from the data read out from the SRAM 121 (step S330). The subtraction result is stored in the SRAM 121 via the sequencer 131. In this case, data read out from the SRAM 121 is divided every two bits in order to count up to 3 from 0 to 3 for each nozzle. In other words, the SRAM 121 needs to have a capacity of three bits for each nozzle in order to count up to 7 for each nozzle, or four bits for each nozzle in order to count up to 15 for each nozzle. In this embodiment, the count of each nozzle is set to 3 at maximum. Note that an initial value is stored in the SRAM 121 at the timing when the printing apparatus is turned on, and is set based on, for example, an SRAM initial value setting signal output from the CPU 110.

The value of the subtraction result in step S330 is rewritten at the same address as that at which data has been read out from the SRAM 121 in step 320 (step S340). To store the subtraction result, the nozzle counter sequencer 120 comprises, for example, a register for holding readout block information. The nozzle counter sequencer 120 may also comprise a register for holding address information of the SRAM 121 as the information held to access, or a block sequence table and a pointer for designating the table. In step S350, it is determined whether or not all data have been printed. If "YES" in step S350, printing ends; if "NO", the operation from step S310 to step S340 is repeated for block 0 to block 15. If the value of the subtraction result rewritten in the SRAM 121 reaches 0, 0 is held until an initial value is newly set on the basis of the SRAM initial value setting signal.

Figure 9:
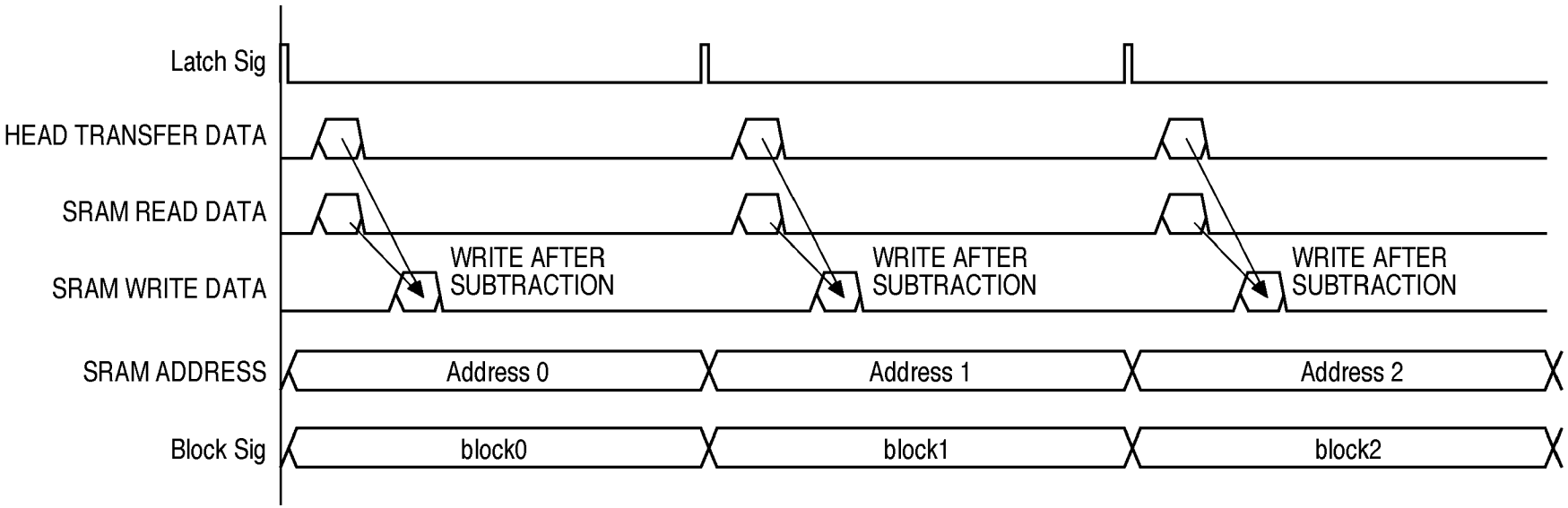
FIG. 9 is a timing chart of operation of a nozzle counter sequencer.

FIG. 9 is a timing chart of operation of the nozzle counter sequencer 120, and is an explanatory chart when the printhead prints during scanning.

Printing data (SRAM read data) is read out from an address corresponding to Block Sig of the SRAM in synchronism with the timing of Latch Sig, and the data is counted. The count value is subtracted from the SRAM read data, and the value after subtraction is rewritten (updated) at the same address as that from which the SRAM read data has been read out. Further, outputs from the subtracters 132_0 to 132_7 are input to an OR circuit 133. One of Latch 0 to Latch 15 latches an output from the OR circuit 133 in synchronism with the timing of the next Latch Sig. This operation is repeated for each Latch Sig during the printing operation.

In FIG. 4, the OR circuit 133 outputs "0" when all outputs from subtracters 0 to 7 are "0"; otherwise, outputs "1". Latch 0 to Latch 15 134_0 to are latch circuits for latching an output from the OR circuit 133 in synchronism with Latch Sig. Latch 0 to Latch 15 are latch circuits corresponding to block 0 to block 15, respectively. One of Latch 0 to Latch 15 is selected based on a value decoded by a decoder 130. For example, Latch 0 latches an output from the OR circuit 133 for block 0. Similarly, Latch 1 latches an output from the OR circuit 133 for block 1. An OR circuit 135 performs OR-operation every time one of Latch 0 to Latch 15 latches an output. When all outputs from Latch 0 to Latch 15 are "0", the OR circuit 135 outputs "0"; otherwise, outputs "1". A Latch circuit 136 latches an output value from the OR circuit 135 in response to a trigger (e.g., Latch command) from the CPU. This embodiment adopts OR circuits to determine information (values) output from a plurality of subtracters and determine information (values) output from a plurality of latch circuits. However, the present invention is not limited to this arrangement.

In this way, the subtracter holds data in unit of transfer to the head logic, and a value after subtraction is rewritten in the SRAM 121. The SRAM 121 has a storage capacity of 2 bits×128 nozzles.

Latch 0 to Latch 15 latch the OR values of values after subtraction for respective blocks. The Latch circuit 136 latches the OR value of values output from Latch 0 to Latch 15. With this arrangement, the amount of transfer data is evaluated, and the evaluation result is stored in the storage means (SRAM) in synchronism with transfer of printing data.

The use of SRAM contributes to reducing the circuit scale much more than a counter formed from an F/F (Flip-Flop). Thus, the above-described arrangement can reduce the circuit scale much more than a conventional arrangement having a counting means for each nozzle.

A time management till preliminary discharge by the CPU 110 will be explained. The CPU 110 controls scanning of the printhead, conveyance of a printing medium, driving of the printhead, and the like.

Figure 13:
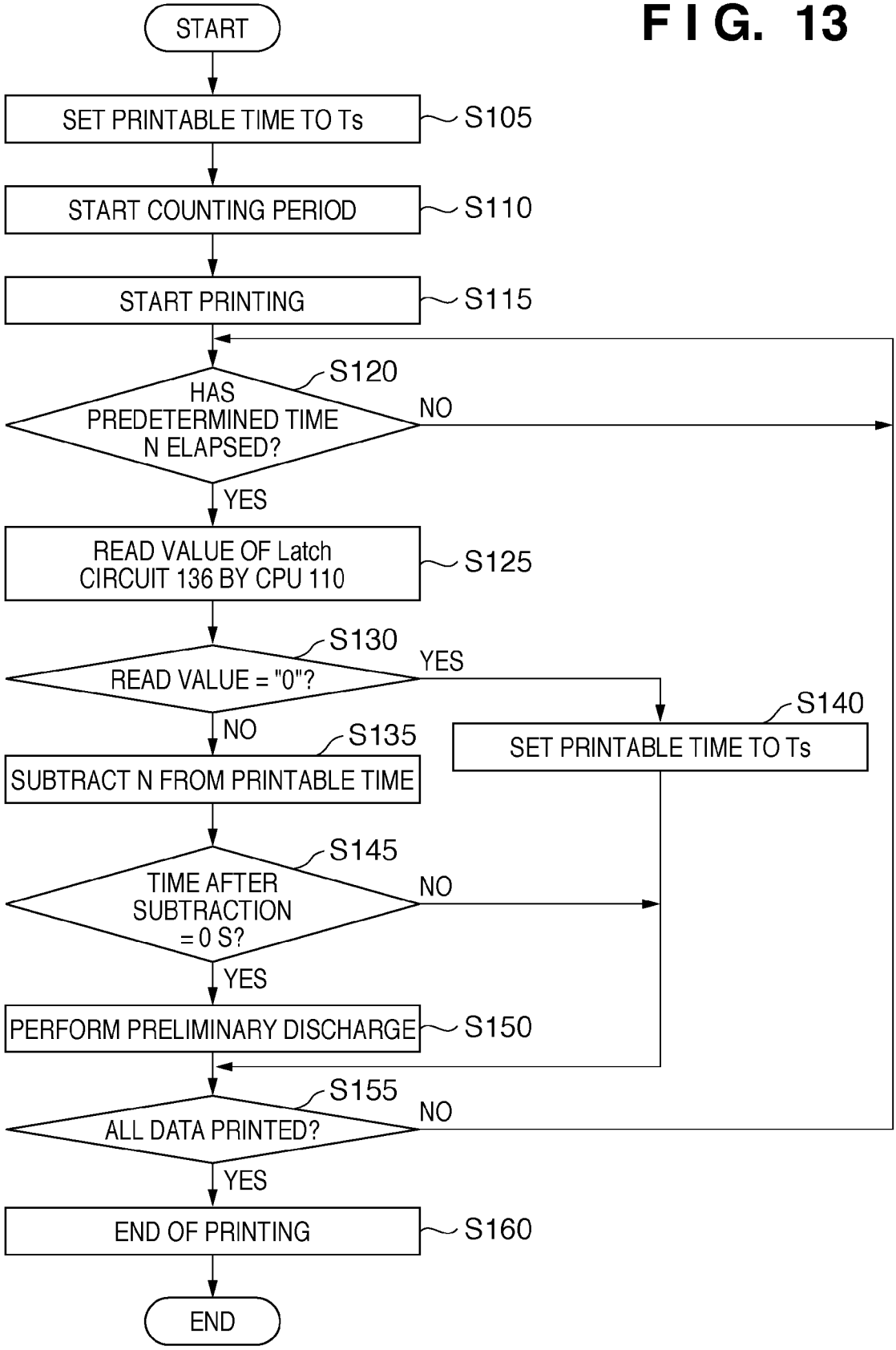
FIG. 13 is a flowchart showing a time management till preliminary discharge by a CPU.

FIG. 13 is a flowchart showing the time management till preliminary discharge by the CPU 110.

The CPU 110 sets a printable time Ts (e.g., 500 mS (milliseconds)) in the internal register of the CPU 110 (step S105). The printable time is a typical time during which printing can be performed without preliminary discharge. In other words, the printable time is a time during which the printing element can discharge a desired ink amount without preliminary discharge. By performing the preliminary discharge operation every time the printable time elapses, the image quality can be maintained. The CPU 110 activates its internal timer, and starts counting the period every predetermined time (step S110). The CPU 110 waits until the result of counting the period represents the lapse of a predetermined time N (e.g. 50 mS) after printing starts in step S115 (step S120). Then, the CPU 110 outputs an SRAM initial value setting signal to the sequencer 131 in order to measure the number of ink discharges periodically (every time N). The sequencer 131 determines whether or not printing is in progress, and outputs an SRAM initialization instruction and latch instruction (Latch command). Based on the Latch command, the Latch circuit 136 latches a value output from the OR circuit 135. Determination of whether or not printing is in progress by the sequencer 131 will be described in detail later.

The CPU 110 reads the value latched by the Latch circuit 136 (step S125), and determines whether or not the read value is "0" (step S130). In other words, the CPU 110 determines whether or not the number of ink discharges by each printing element is equal to or larger than a predetermined number. If the read value is "0", the CPU 110 determines that all nozzles have performed a predetermined number of discharges (three discharges in this example), and sets the printable time Ts in the internal register of the CPU (step S140). If all data have been printed (YES in step S155), printing ends (step S160), and the operation sequence ends. If all data have not been printed, the process returns to step S120 to wait until the result of counting the period represents the lapse of the predetermined time N.

If it is determined in step S130 that the read value of the Latch circuit 136 is "1", the CPU 110 determines that any nozzle has not performed the predetermined number of discharges, and adjusts the printable time Ts held by the internal register of the CPU (step S135). In this adjustment, the CPU 110 subtracts N from the printable time Ts. If the time after subtraction is not 0 S (seconds) (NO in step S145), the process proceeds to step S155. If the time after subtraction is 0 S (YES in step S145), preliminary discharge is performed (step S150). As another embodiment, the printable time Ts may also be set in step S150 at the same time as performing preliminary discharge.

More specifically, when the printable time is 500 mS, the CPU 110 reads the value of the Latch circuit 136 every 50 ms. If the read value is "0", the CPU 110 resets the printable time to 500 mS; if the read value is "1", it subtracts 50 mS from the printable time. In this fashion, the printable time is adjusted based on the determination result ("1" or "0"). For example, when 10 successive determination results (read values) are "1", the printable time becomes 0 mS, so preliminary discharge needs to be performed. If a determination result (read value) "0" is read during the printable time, the printable time is reset to 500 mS, so no preliminary discharge need be performed. The count at which the printhead moves to the preliminary discharge position spaced apart from the printing area can be decreased. Since preliminary discharge is performed only when necessary, a decrease in throughput can be suppressed.

The operation of the sequencer 131 will be explained.

The internal timer of the CPU 110 is irrelevant to the timing of the printing operation, and thus an instruction to initialize the SRAM 121 is asynchronously issued even during read/write operation of data from/to the SRAM 121 in the printing operation. If the SRAM is initialized during read/write operation of data from/to the SRAM, printing data is sometimes miscounted. To prevent this, even if the CPU 110 issues an instruction to initialize the SRAM 121, the SRAM 121 is initialized at a timing when read/write operation of data from/to the SRAM 121 reliably end. More specifically, it is controlled to wait initialization of the SRAM 121 and the latch operation of the Latch circuit 136 until the next Latch Sig is input.

Figure 10:
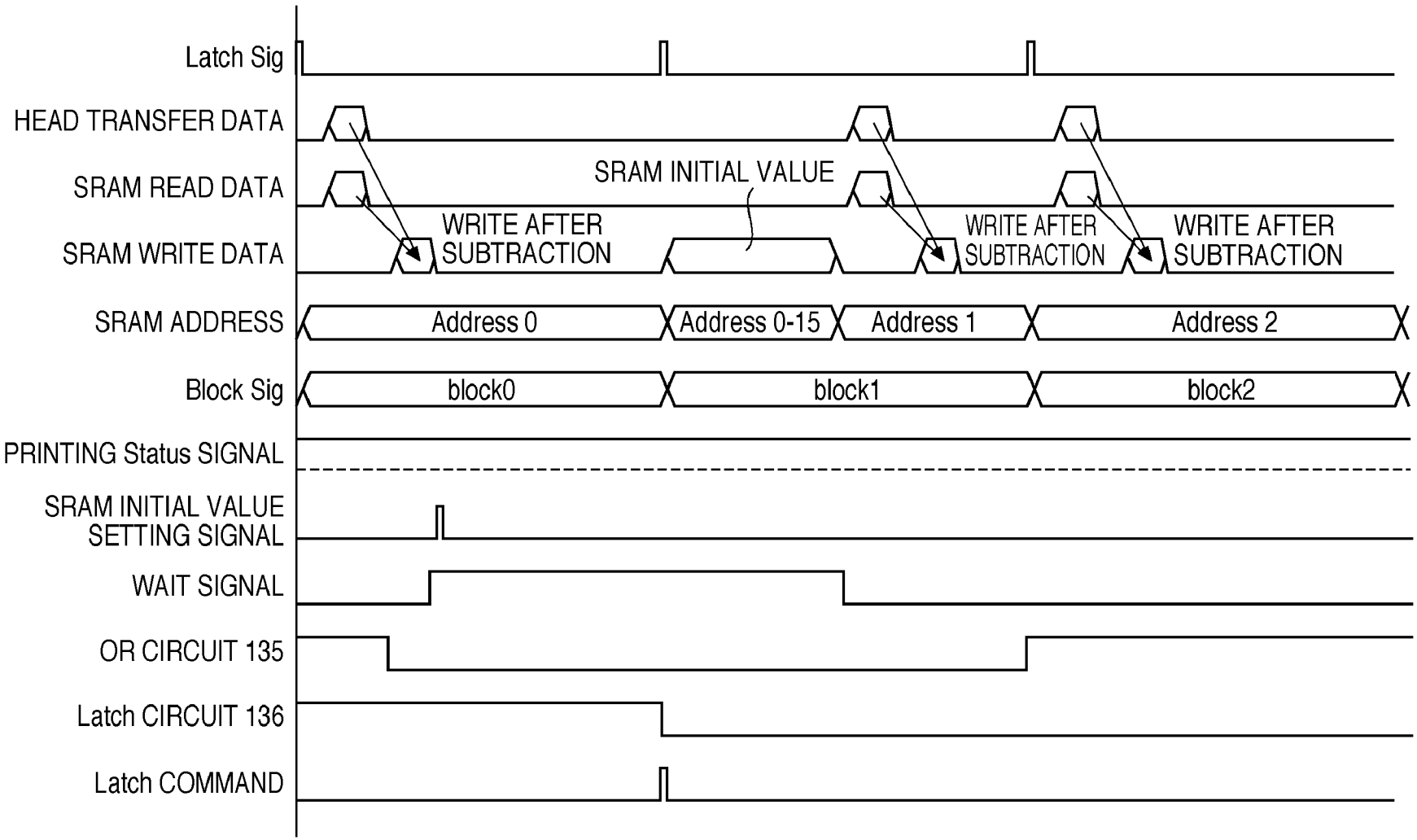
FIG. 10 is a timing chart showing the wait operation timing of a sequencer.

FIG. 10 is a timing chart showing the wait operation timing of the sequencer 131.

When the CPU 110 outputs an SRAM initial value setting signal, the sequencer 131 asserts a wait signal. When Latch Sig is input while the wait signal is asserted, the SRAM 121 is initialized. For example, letting 3 be an initial value, the SRAM 121 is initialized by setting "3" ("11" represented by two bits) in areas allocated to address 0 to address 15.

After the end of initializing the SRAM 121, data of Block 1 is read out from address 1, head transfer data is subtracted from the data, and the resultant data is written at address 1.

Upon receiving Latch Sig while the wait signal is asserted, the sequencer 131 outputs Latch command to the Latch circuit 136. In response to Latch command, the Latch circuit 136 latches the value of the OR circuit 135.

As described above, when an SRAM initial value setting signal is input during the printing operation, initialization of the SRAM 121 and the latch operation of the Latch circuit 136 wait until the next Latch Sig is input. Hence, all printing data can be counted without miscounting printing data. A printing Status signal represents whether or not printing is in progress. When the printing Status signal is at high level, this means that printing is in progress. For example, when the scanning printhead discharges ink, the printing Status signal is at high level. To the contrary, when the printing Status signal is at low level, this means that no printing is in progress.

If the predetermined time N elapses during a non-printing operation, the CPU 110 issues an instruction to initialize the SRAM 121. Since no printing operation is in progress at this time, no Latch Sig is input to the sequencer 131. As the state of the non-printing operation, wait for reception of data from the host PC is assumed.

Figure 11:
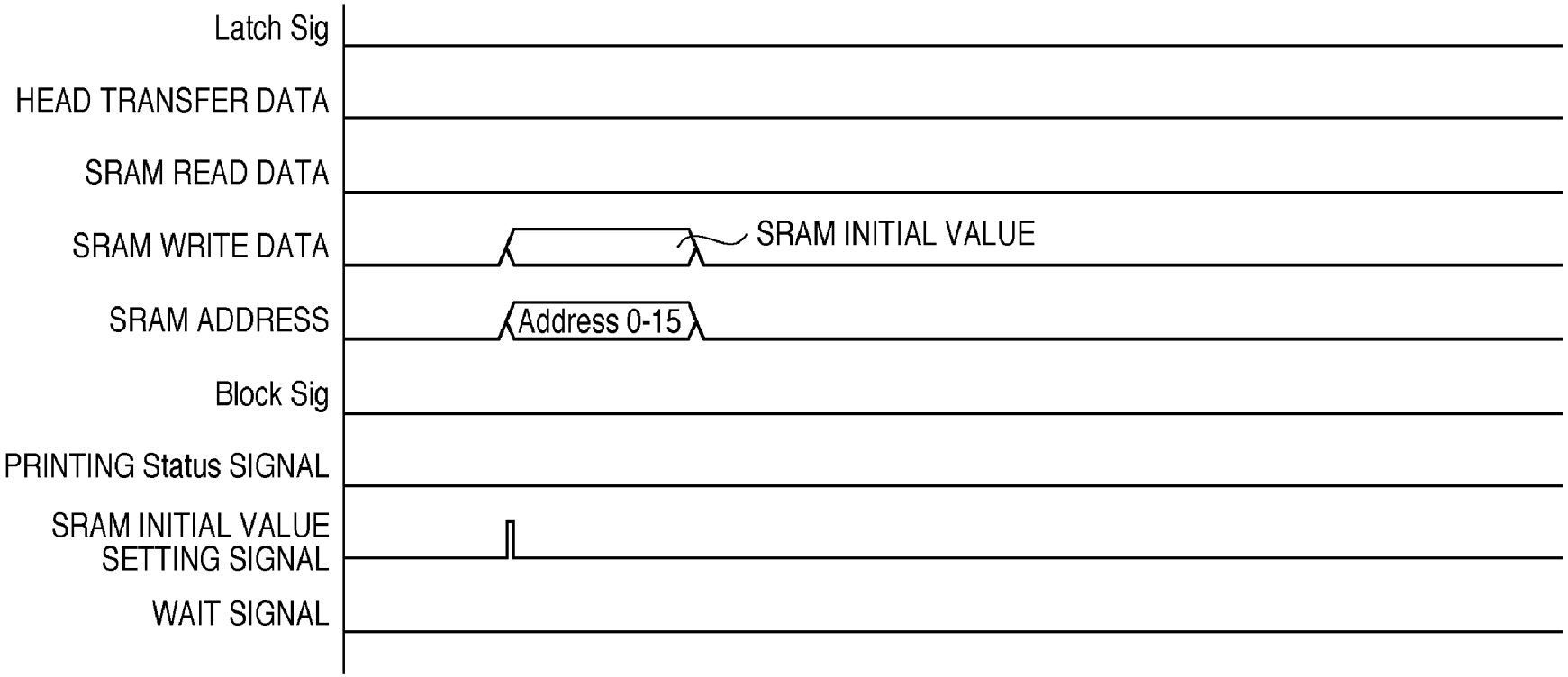
FIG. 11 is a timing chart when an instruction to initialize an SRAM is issued during a non-printing operation.

The sequencer 131 determines based on the state of the printing Status signal whether or not printing is in progress. If the CPU 110 has issued an instruction during the printing operation to initialize the SRAM 121, the sequencer 131 generates a wait signal. If the CPU 110 has issued an instruction during a non-printing operation to initialize the SRAM 121, the SRAM 121 is immediately initialized, and the Latch circuit 136 latches the value of the OR circuit 135 immediately after the instruction. FIG. 11 is a timing chart when the instruction to initialize the SRAM 121 is issued during a non-printing operation. In this fashion, the SRAM 121 is initialized immediately after issuing the instruction to initialize the SRAM 121.

Figure 14:
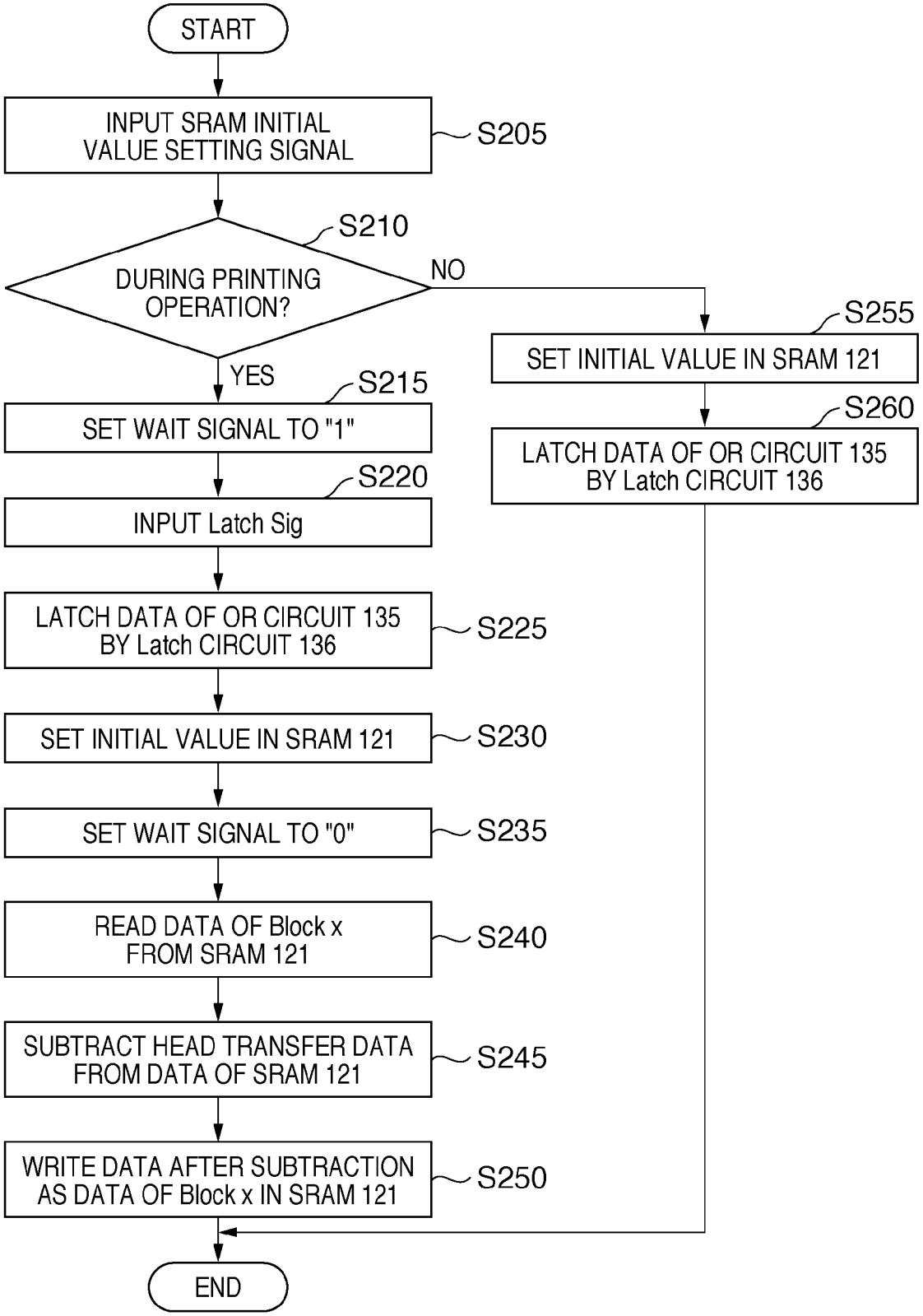
FIG. 14 is a flowchart when initializing the SRAM.

FIG. 14 is a flowchart when initializing the SRAM 121.

If the CPU 110 issues an instruction to initialize the SRAM 121 (step S205), the sequencer 131 determines from the printing Status signal whether or not printing is in progress (step S210). If no printing is in progress, the SRAM 121 is set to an initial value immediately (step S255), and the Latch circuit 136 latches data of the OR circuit 135 (step S260). If it is determined in step S210 that printing is in progress, the wait signal is set to "1" (signal level is set high) (step S215), and the process waits until Latch Sig is input. After Latch Sig is input (step S220), the Latch circuit 136 latches data of the OR circuit 135 (step S225), and the SRAM 121 is set to an initial value (step S230). Then, the wait signal is set to "0" (signal level is set low), and data of Block x is read from the SRAM 121 (step S240). Head transfer data is subtracted from the data read from the SRAM 121 (step S245), and the value after subtraction is written into the SRAM 121 (step S250).

As described above, the sequencer 131 determines whether or not printing is in progress, and changes the initialization operation of the SRAM 121 depending on whether printing is in progress or not. Even during a non-printing operation during which no Latch Sig is input, it is possible to initialize the SRAM 121 and latch data by the Latch circuit 136. The printing Status signal is generated based on an encoder signal, becomes "1" only while the carriage 2 moves above the printing area of the printing medium 4, and is generated in the sequence controller 104.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-173114, filed Jun. 29, 2007, which is hereby incorporated by reference herein in its entirety.

What is claimed is:

1. A printing apparatus which divides printing elements into blocks, and time-divisionally drives the printing elements of the respective blocks to discharge ink to a printing medium, the apparatus comprising:

input means for externally inputting printing data;

generation means for generating a timing signal of time-divisional driving;

evaluation means for evaluating, based on the printing data input from said input means, a driving count at which the printing elements are driven;

memory means for holding information on the driving count for each block;

update means for updating the information on the driving count stored in said memory means, based on the driving count evaluated by said evaluation means in synchronism with the timing signal;

determination means for determining, based on the information on the driving count updated by said update means, whether or not to adjust a printable time;

adjustment means for adjusting the printable time in a predetermined period, based on determination by said determination means; and control means for performing preliminary discharge from the printing elements, based on the printable time adjusted by said adjustment means.

2. The apparatus according to claim 1, wherein said update means includes subtraction means for subtracting a value of the information on the driving count.

3. The apparatus according to claim 2, wherein said subtraction means subtracts information on the driving count of each of the printing elements belonging to each block.

4. The apparatus according to claim 1, wherein said determination means includes holding means for holding, for each block, a result of determining whether or not to adjust the printable time.

5. The apparatus according to claim 1, wherein said determination means determines, in synchronism with the timing signal, whether or not to adjust the printable time.

6. The apparatus according to claim 1, wherein said update means initializes the information on the driving count held in said memory means in the predetermined period.

7. The apparatus according to claim 1, wherein the printable time includes a time during which the printing elements discharge a predetermined ink amount.

8. A method of controlling a printing apparatus which divides printing elements into blocks, and time-divisionally drives the printing elements of the respective blocks to discharge ink to a printing medium, the method comprising:

an input step of externally inputting printing data;

a generation step of generating a timing signal of time-divisional driving;

an evaluation step of evaluating, based on the printing data input in the input step, a driving count at which the printing elements are driven;

an update step of updating the information on the driving count held in memory means, based on the driving count evaluated in the evaluation step in synchronism with the timing signal;

a determination step of determining, based on the information on the driving count updated in the update step, whether or not to adjust a printable time;

an adjustment step of adjusting the printable time in a predetermined period, based on a result of determination in the determination step; and a control step of performing preliminary discharge from the printing elements, based on the printable time adjusted in the adjustment step.

* * * * *